US011382353B1

(12) United States Patent
Wahidi

(10) Patent No.: US 11,382,353 B1
(45) Date of Patent: Jul. 12, 2022

(54) INSERT SYSTEM INCLUDING FLAVOR RELEASING MECHANISM HELD WITHIN A POLYMER HOLDER

(71) Applicant: Jawid Wahidi, Irvine, CA (US)

(72) Inventor: Jawid Wahidi, Irvine, CA (US)

( * ) Notice: Subject to any disclaimer, the term of this patent is extended or adjusted under 35 U.S.C. 154(b) by 0 days.

(21) Appl. No.: 17/583,817

(22) Filed: Jan. 25, 2022

(51) Int. Cl.
*A24D 3/04* (2006.01)
*A24D 3/06* (2006.01)
*A24D 3/18* (2006.01)

(52) U.S. Cl.
CPC ..... *A24D 3/061* (2013.01); *A24D 3/048* (2013.01); *A24D 3/18* (2013.01)

(58) Field of Classification Search
None
See application file for complete search history.

(56) References Cited

U.S. PATENT DOCUMENTS 2,992,154 A * 7/1961 Stella ..... A24D 3/06 162/28
2018/0368468 A1* 12/2018 Mishra ..... A24D 3/06
2021/0219600 A1* 7/2021 Shoor ..... A24D 3/061

* cited by examiner

*Primary Examiner* — Dennis R Cordray
(74) *Attorney, Agent, or Firm* — Cohen IP Law Group, PC; Michael N. Cohen

(57) ABSTRACT

An insert system including a flavor releasing mechanism held within a compressible polymer holder disposed between two filter elements is provided. The insert system may be used as a mouthpiece with any type of suitable smokable, including, but not limited to, a blunt, a cigar, a cigarette, a cone, a pre-roll, an empty cone, any other type of smokable, and any combinations thereof. The insert system may be squeezed to activate the flavor releasing mechanism to release flavor into the smoke passing through the insert system to enhance the smoking experience. In one example, the insert system is coupled with one or more Cordia leaves to form a blunt smokable.

9 Claims, 5 Drawing Sheets

INSERT SYSTEM INCLUDING FLAVOR RELEASING MECHANISM HELD WITHIN A POLYMER HOLDER

FIELD OF THE INVENTION

The present invention relates to smokable pre-rolls, including smokable pre-rolls with embedded flavor releasing mechanisms.

BACKGROUND

A new phenomenon is happening within the smokables industry wherein consumers purchase cigars, remove the tobacco leaves from within the cigars (while leaving the outer tobacco leaf shells and mouthpieces), and subsequently fill the hollow cigars with his/her own smokable materials (e.g., cannabis).

Another phenomenon involving the inclusion of flavor releasing mechanisms within a smokable insert also is becoming very popular. In many cases, the flavor releasing mechanisms include small spheres filled with a flavoring substance (also known as "click balls") that are designed to be squeezed by the user to effectively explode and release the flavoring.

Accordingly, there is a need for an insert system including one or more flavor releasing mechanisms that may be used for these types of smokables to maximize the smoking experience.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

For the purposes of this specification, the terms below will mean the following.

Cigarette generally refers to a smokable comprising a thin cylinder of finely cut tobacco, cannabis, other types of leaves, flowers, herbs, and/or other smokable materials, rolled in a suitable paper or leaf for smoking. A cigarette may or may not include a mouthpiece (e.g., an insert, a filter, etc.).

Cigar generally refers to a cylinder of tobacco rolled in tobacco leaves for smoking. A cigar may or may not include a mouthpiece (e.g., an insert).

Blunt generally refers to a cigar that has been hollowed out and filled with other types of smokable materials (e.g., cannabis). A blunt may typically include a mouthpiece, such as the insert system described herein, however, this may not be necessary.

Figure 1:
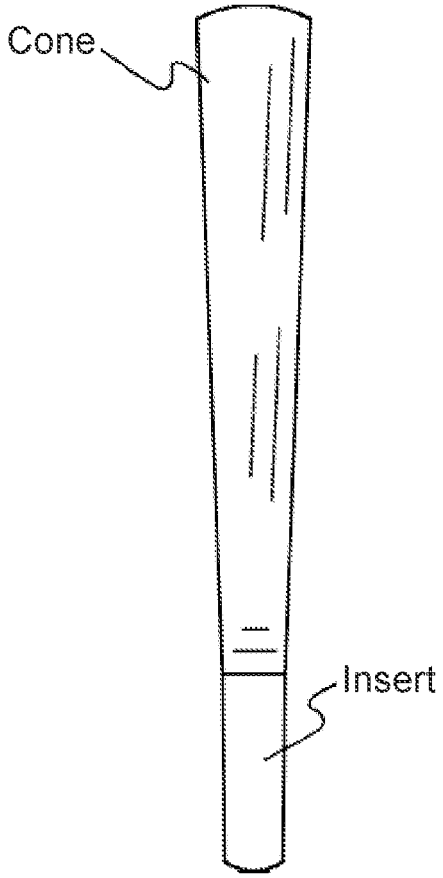
FIG. 1 (Prior Art)
FIG. 1 show aspects of a smokable cone (prior art)

Cone generally refers to a conical- or frustum-shaped cigarette (or "joint") wherein the shape flares from a smaller diameter proximal base to a larger diameter distal tip (see FIG. 1). Cones may typically comprise paper, hemp, palm leaves, tobacco leaves, rice, cotton, cellulose, glycerin, and/or other suitable materials.

Pre-roll generally refers to a cigarette or cone that has been formed prior to its sale and is therefore consumer-ready (i.e., a consumer is not required to fill or otherwise form the smokable).

Empty cone refers to an empty cone into which a consumer may place smokable materials (e.g., tobacco, cannabis, etc.) to form a smokable cone.

Insert generally refers to a mouthpiece or tip coupled with a cone, blunt or cigarette (see FIG. 1) that acts to support the proximal end of the smokable (e.g., the end that is pressed against one's lips for smoking). An insert may include a "crutch" formed of thick paper, glass or other materials, a filter (e.g., a cotton filter), other types of inserts, and any combinations thereof. Inserts may be used with cigarettes, blunts, cones (pre-rolled, empty, etc.), rolling papers, and other types of smokable items.

In general, and according to exemplary embodiments hereof, an insert system 10 including a flavor releasing mechanism held within a compressible polymer holder disposed between two filter elements is provided. The insert system 10 may be used as a mouthpiece with any type of suitable smokable, including, but not limited to, a blunt, a cigar, a cigarette, a cone, a pre-roll, an empty cone, any other type of smokable, and any combinations thereof. The insert system 10 may be squeezed to activate the flavor releasing mechanism to release flavor into the smoke passing through the insert system 10 to enhance the smoking experience.

In an exemplary embodiment, the insert system 10 is configured with one or more Cordia palm leaves and formed as a blunt.

Figure 2:
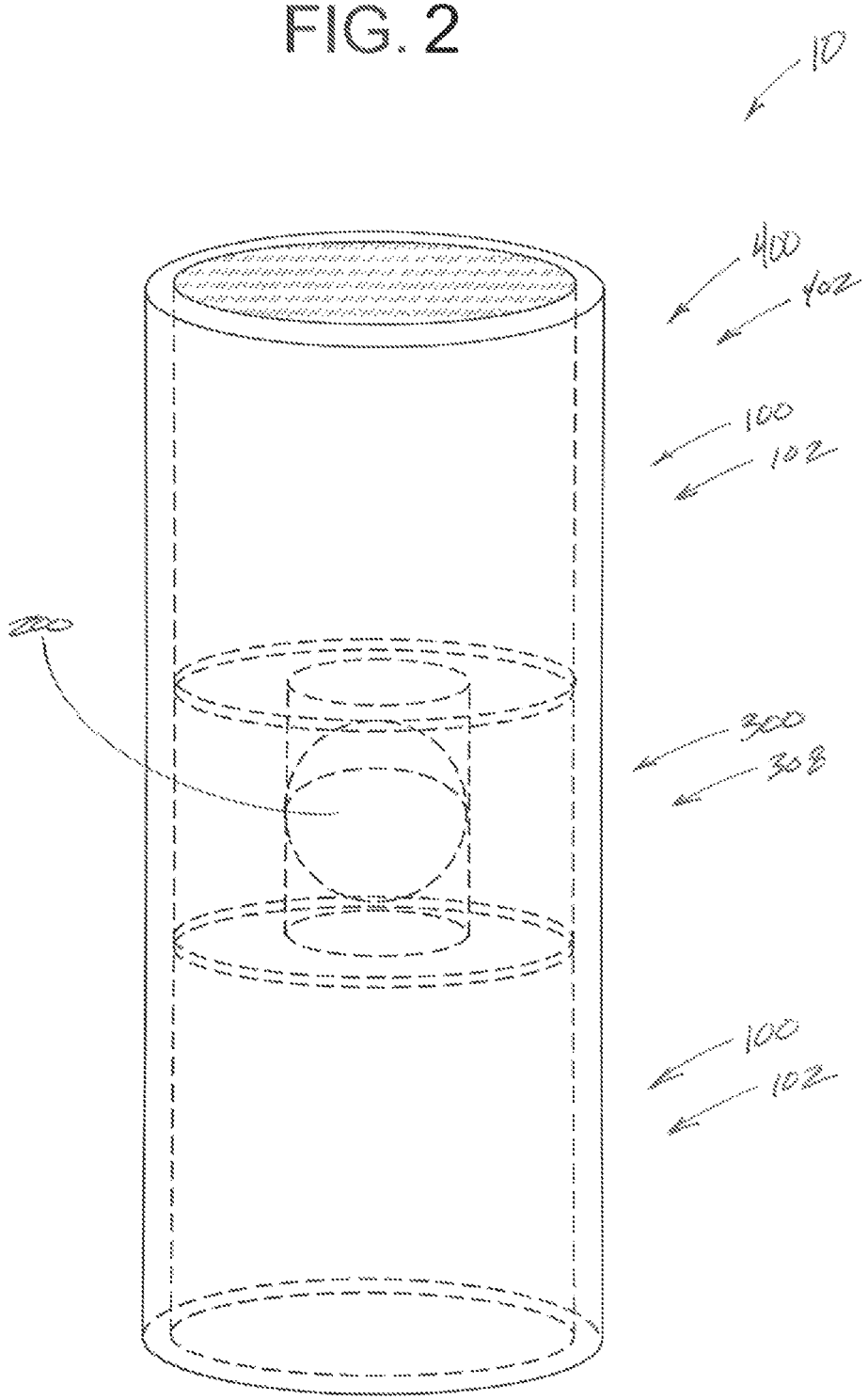
FIG. 2 shows aspects of an insert system according to exemplary embodiments hereof.
Figure 3:
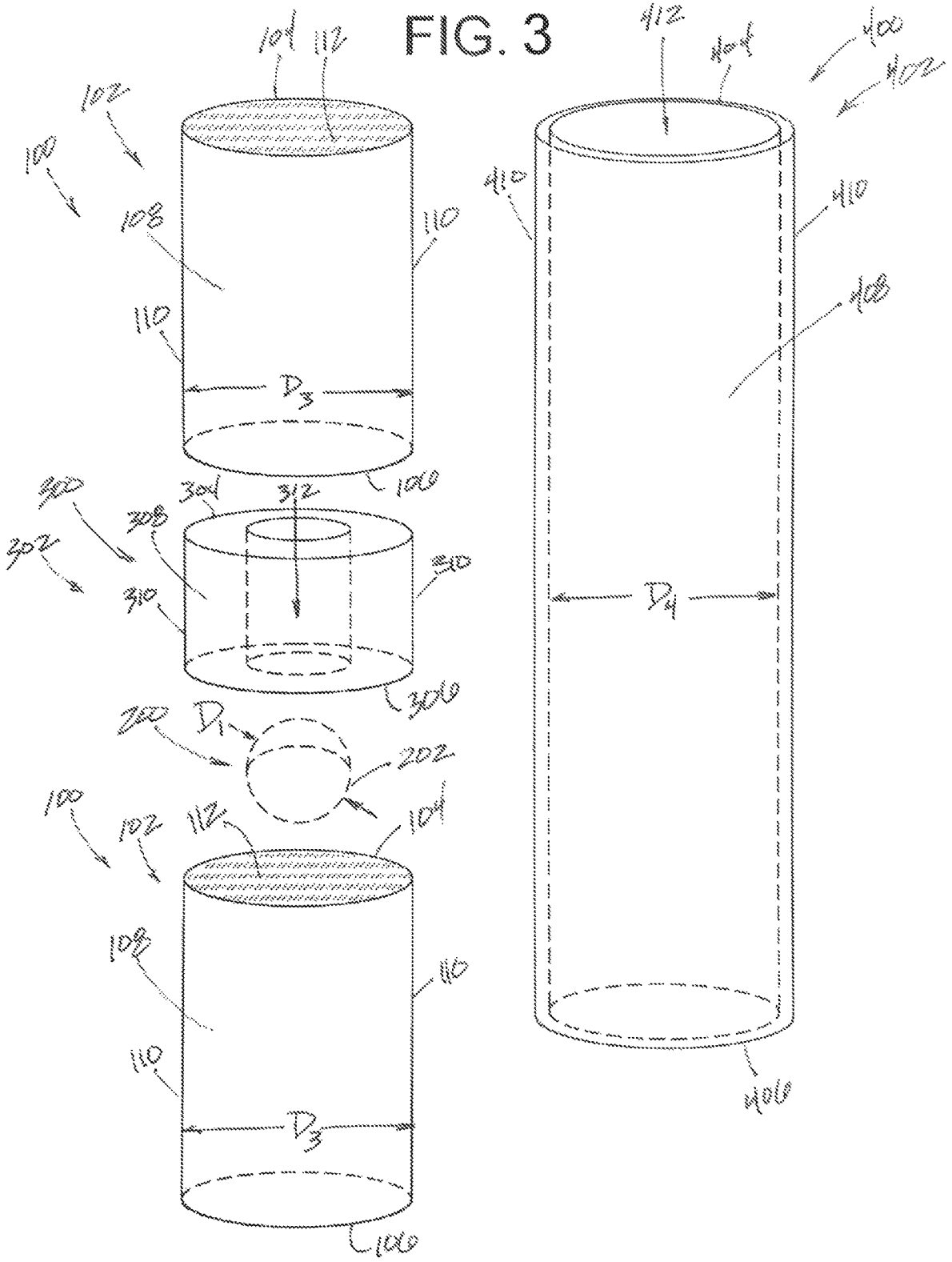
FIG. 3 shows an exploded view of the insert system of FIG. 2 according to exemplary embodiments hereof.

In one exemplary embodiment hereof as shown in FIGS. 2 and 3, the insert system 10 includes a filter assembly 100 including one or more filter elements 102, a flavor mechanism 200, a flavor mechanism holding structure 300, and an outer shell structure 400. FIG. 2 shows a schematic of the insert system 10 and FIG. 3 shows an exploded view of the same. In general, the flavor mechanism 200 is held within the flavor mechanism holding structure 300, a first filter element 102 abuts the flavor mechanism holding structure 300 on a first end, a second filter element 104 abuts the flavor mechanism holding structure 300 on a second end, and the first filter element 102, the flavor mechanism holding structure 300 including the flavor mechanism 200 held therein, and the second filter element 102 are held together within the outer shell structure 400. The insert system 10 also may include other elements to fulfill its functionalities as described herein.

Filter Assembly 100

In some embodiments, as shown in FIG. 2, the filter assembly 100 includes one or more filter elements 102, with each filter element 102 including a first end 104, a second end 106 and a filter body 108 with side walls 110 extending from the first end 104 to the second end 106. In some embodiments, the filter body 108 is generally cylindrical with a generally circular cross-section. However, it is understood that the filter body 108 may include other shapes (e.g., frustum shaped), with other shaped cross sections (e.g., oval) and any combinations thereof.

In some embodiments, the filter body 108 comprises a filter material 112. In some embodiments, the filter material 112 comprises one or more plant materials, such as, but not limited to, husk material, leaf material, stalk material, stem material, seed material, vegetable material, fruit material, other types of plant material(s), and any combinations thereof.

In some embodiments, the filter material 112 includes corn husk material. The corn husk material may be bunched together and generally aligned to extend between the filter element's first end 104 and second end 106. In this way, the corn husk material may allow smoke to pass through the filter element body 108 from the first end 104 to the second end 106 (and vice versa) while acting as a filter to the smoke.

In some embodiments, the filter element's side walls 110 may comprise a suitable wrapping material. In this case, the side walls 110 also may comprise corn husk material generally wrapped around or otherwise surrounding the filter material 112 (e.g., the bunched corn husk material) and holding it in its intended form (e.g., generally cylindrical) as shown. The side walls 110 also may comprise any suitable wrapping material such as paper, cardboard, plastic, leaves, any other type of suitable material, and any combinations thereof. It also is contemplated that the filter material 112 (e.g., the corn husk material) is simply bunched together to form the side walls 110 directly from the filter material 112 and the filter body 108 may not necessarily be wrapped.

Flavor Mechanism 200

In some embodiments as shown in FIG. 3, the flavor mechanism 200 includes any type of solid, liquid, or gas (and any combinations thereof) that may release one or more flavors when activated. The mechanisms 200 may be designed to be activated by heat (e.g., during smoking), by pressure (e.g., may be squeezed, pricked, or otherwise exploded, etc.), by other activation techniques, and by any combinations thereof.

In some embodiments as shown in FIG. 3, the flavor mechanisms 200 include one or more flavor balls 202 (also referred to as click balls) comprising a crushable spherical container with a flavoring substance inside. The click balls 202 may be adapted to generally burst (or otherwise open) when squeezed thereby releasing the flavoring substance. In this way, a user may squeeze a click ball 202 embedded within the insert system 10 when a flavoring is desired during the smoking experience.

In some embodiments, as shown in FIG. 3, the width or diameter $D_1$ of the flavor mechanism 200 (e.g., the diameter of a flavor ball 202) is about 2 mm-5 mm, but other widths or diameters $D_1$ also may be used.

While the flavor balls 202 described herein are described primarily as spherically shaped, it is understood that the flavor balls 202 may be formed as an ovoid, a cuboid, a cylinder, tubular, pill-shaped, as any other suitable shape, and as any combinations thereof. It is understood that any other type(s) and/or shapes of flavor mechanisms 200 may be used with the insert system 10, and that the scope of the insert system 10 is not limited in any way by the type of flavor mechanism(s) 200 used.

Flavor Mechanism Holding Structure 300

Figure 4:
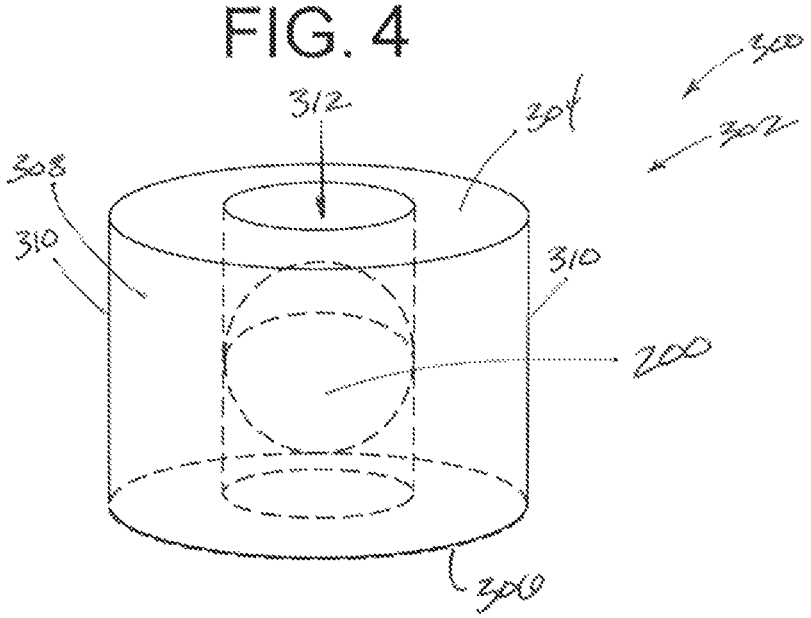
FIGS. 4-5 show aspects of a flavor mechanism holding structure according to exemplary embodiments hereof.

In some embodiments, as shown in FIGS. 3 and 4, the flavor mechanism holding structure 300 (also referred to as simply the holding structure 300) includes a holder element 302 adapted to receive and generally surround and hold the flavor mechanism 200.

In some embodiments, as shown in FIGS. 2-4, the holder element 302 includes a generally tubular structure including a first end 304, a second end 306 and a holder body 308 with side walls 310 extending from the first end 304 to the second end 306. Being generally tubular, the holder body 308 includes a hollow inner passageway 312 extending from its first end 304 to its second end 306. In some embodiments, the holder body 308 and the inner passageway 312 include generally circular cross-sections. However, it is understood that the holder body 308 may include other shapes (e.g., frustum shaped), with other shaped cross sections (e.g., oval) and any combinations thereof. It also is understood that the inner passageway 312 may include other shapes (e.g., may be frustum shaped) and that the cross section of the inner passageway 312 may be circular, cuboid, ovoid, polygonal, include other shapes and any combination thereof.

In some embodiments, the holder body 308 comprises a compressible material. In some embodiments, the holder body 308 is compressible so that the holder body 308 may be squeezed using normal human strength to deflect the side walls 310 inward. This deflection may in turn compress a flavor mechanism 200 held within the holder body 308 so that the flavor mechanism 200 may burst or otherwise open and release flavor as described in other sections.

In some embodiments, the holder body 308 comprises a polymer. In some embodiments, the holder body 308 includes silicone (e.g., preferably food grade silicone). In other embodiments, the holder body 308 comprises rubber, plastic, other types of polymers, paper, cotton, a gelatinous substance (e.g., gelatin or other gelatinous substances), foam, webbing, other compressible materials, and any combinations thereof.

In some embodiments, the holder body 308 may be solid, porous, and any combinations thereof.

Figure 5:
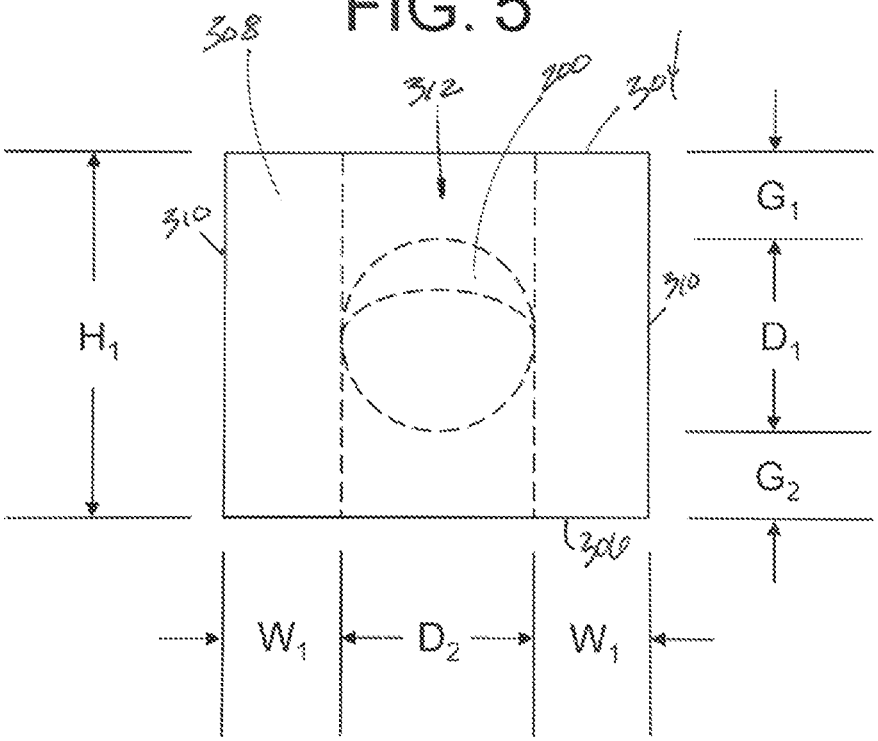

In some embodiments, as shown in FIGS. 4 and 5, the holder body 308 is designed to receive and secure a flavor mechanism 200 within its structure, e.g., within its hollow inner passageway 312. FIG. 4 shows a schematic of the holding structure 300 including a flavor mechanism 200 and FIG. 5 shows a side view of the same. In some embodiments, the width or diameter $D_2$ of the inner passageway 310 preferably matches the width or diameter $D_1$ of the flavor mechanism 200 (see FIG. 2). In this way, the flavor mechanism 200 may be held within the holder body 308 (within the inner passageway 312) by friction between the flavor mechanism 200 and the inner side walls of the inner passageway 312.

In some embodiments, the width or diameter $D_2$ of the inner passageway 312 may be chosen to be slightly less than the width or diameter $D_1$ of the flavor mechanism 200. In this way, the inner passageway 312 may expand upon receiving the flavor mechanism 200 (the holder body 308 comprising a compressible material) to accommodate the mechanism's 200's slightly wider width $D_1$. Given this, the flavor mechanism 200 may be held within the holder body 308 (within the inner passageway 312) by friction between the flavor mechanism 200 and the inner side walls of the inner passageway 312, the friction being increased by the compressive force applied to the flavor mechanism 200 by the expanded inner passageway 312.

In some embodiments, as shown in FIGS. 4-5, the flavor mechanism 200 is located within the inner passageway 312 between the first end 304 and the second end 306, and preferably about midway between the first end 304 and the second end 306. In some embodiments, the height H1 of the holding structure 300 is greater than the diameter $D_1$ of the flavor mechanism 200 so that a first gap $G_1$ exists between the first end 304 and the flavor mechanism 200, and a second gap $G_2$ exists between the second end 306 and the flavor mechanism 200. In this way, as shown in FIG. 2, with a filter element 102 abutted the first end 304 and/or the second end 306 of the holder body 308, the filter elements 102 do not come into physical contact with the flavor mechanism 200 (due to the gaps $G_1$, $G_2$ separating the filter elements 102 from the flavor mechanism 200 as shown in FIG. 5). In other words, the flavor mechanism 200 fits entirely within the inner passageway 310.

In some embodiments, as shown in FIG. 5, the overall diameter of the holder body 308 is equal to the diameter $D_2$ of the inner passageway 310 plus twice the width $W_1$ of the holder body's side walls 310. As will be described in other sections, it may be preferable that the diameter of the holder body 308 generally match the diameter $D_3$ of the filter element 102 (see FIG. 3) so that the parts all fit snug within the outer shell structure 400 as described in other sections. Given this, the width W1 of the holder body's side walls 310 should preferably be chosen so that the diameter $D_2$ of the inner passageway 310 plus twice the width $W_1$ of the holder body's side walls 310 generally equals the diameter $D_3$ of a filter element 102 (see FIG. 3) plus or minus any uncertainty amount due to manufacturing tolerances.

Outer Shell Structure 400

In some embodiments, as shown in FIGS. 2 and 3, the outer shell structure 400 (also referred to as simply the shell 400) includes a shell element 402 adapted to receive and generally surround and hold the filter elements 102 and the flavor mechanism holder body 308 (including a flavor mechanism 200) to form the insert system 10.

In some embodiments, as shown in FIGS. 2-3, the outer shell structure 400 includes a generally tubular structure including a first end 404, a second end 406 and a shell body 408 with side walls 410 extending from the first end 404 to the second end 406. Being generally tubular, the shell body 408 includes a hollow inner passageway 412 extending from its first end 404 to its second end 406. In some embodiments, the shell body 408 and the inner passageway 412 include generally circular cross-sections. However, it is understood that the shell body 408 may include other shapes (e.g., frustum shaped), with other shaped cross sections (e.g., oval) and any combinations thereof. It also is understood that the inner passageway 412 may include other shapes (e.g., may be frustum shaped) and that the cross section of the inner passageway 412 may be circular, cuboid, ovoid, polygonal, include other shapes and any combination thereof.

In general, as shown in FIGS. 2-3, the shell element 402 is adapted to receive and securely hold a first filter element 102, a holder body 308 (including at least one flavor mechanism 200), and a second filter element 102 with the longitudinal axis of each of the first filter element 102, the holder body 308, and the second filter element 102 generally aligned with the longitudinal axis of the shell element 402 as shown (all vertical and centered along each element as shown in FIG. 2). However, it also is contemplated that the longitudinal axis of the holder body 308 may be aligned perpendicular or at other offset angles with respect to the longitudinal axis of the shell element 402 and the filter elements 102.

In some embodiments, as shown in FIGS. 3 and 5, the inner passageway 412 includes a diameter $D_4$. It may be preferable that the diameter $D_4$ be chosen to generally match the diameter $D_2$ of the first and second filter elements 102, as well as the diameter of the holder body 308. In this way, the first and second elements 102 and the holder body 308 may be inserted into the shell element's inner passageway 412 and be held snugly therein.

In some embodiments, as shown in FIGS. 2, 3, and 5, the height of the shell element 402 generally matches the height of the first filter element 102 plus the height of the holder body 308 $H_1$ plus the height of the second filter element 102 so that the first and second filter elements 102 and the holder body 308 may be entirely received into the shell element's inner passageway 412.

In some embodiments, the shell element 402 comprises cardboard, paper, a polymer (e.g., silicone), rubber, plastic, leaves, other suitable materials, and any combinations thereof. It is preferable that the shell element 402 comprise a material that when its sidewalls 410 are squeezed using normal human strength, the walls 410 of the shell element 402 may deflect inward. This deflection may in turn compress the holder body 308 and the flavor mechanism 200 held therein so that the flavor mechanism 200 may burst or otherwise open and release flavor as described in other sections.

In some embodiments, an outer surface of the shell element's sidewalls 410 may include colorings, graphics, text, indicia including instructional information, etc.

In some embodiments, once the insert system 10 has been formed as described above or otherwise, it may be used as a tip, a mouthpiece, a crutch, a filter, as any type of base for a blunt, cigar, pre-roll, cone, empty cone, cigarette, other type of smokable, and for any combinations thereof as known in the art or otherwise. For example, in some embodiments, the insert system 10 may be provided to manufacturers of blunts, pre-roll cones and/or cigarettes, of empty cones, etc. to be coupled to these types of products and then sold to consumers. In another example, the insert system 10 may be coupled with a blunt, pre-roll cone and/or cigarette, and/or to an empty cone during its manufacturing and made for sale to consumers as the combination. In another example, the insert system 10 may be sold directly to consumers such that the consumers themselves may couple the insert system 10 with a leaf or rolling paper to form a cigarette, a cone, an empty cone, a cigar, a blunt, or other type of smokable item. It is understood that the examples described above are meant for demonstration and are non-limiting.

Figure 6:
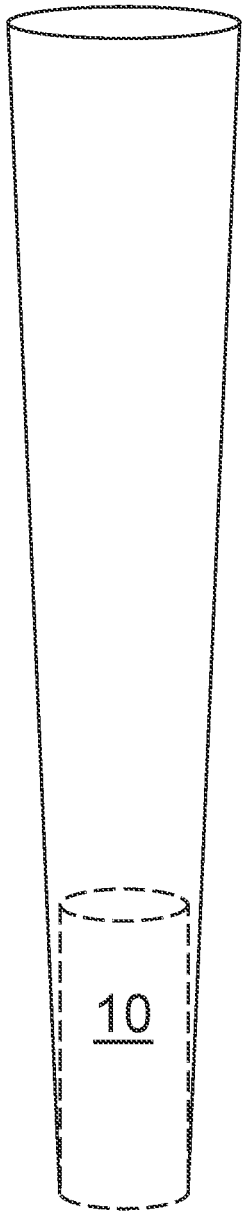
FIG. 6 shows an insert system coupled with a one or more leaves to form a blunt according to exemplary embodiments hereof.

FIG. 6 shows the insert system 10 coupled with one or more leaves (e.g., Cordia leaves) to form a blunt.

It is understood that any details and/or aspects of any embodiments described herein may be combined with any details and/or aspects of any other embodiments in any way to form additional embodiment(s) all of which are within the scope of the filter system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. An insert system for use as a mouthpiece to a smokable item and for securing at least one flavor releasing mechanism, the insert system comprising:

an elongate member with a first open end and a second open end opposite the first open end defining a first inner volume extending therebetween;

a first filter element comprising husk material within the inner volume and directly adjacent the first open end;

a second filter element comprising husk material within the inner volume and directly adjacent the second open end;

a tubular holder comprising silicone and having a third open end and a fourth open end opposite the third open end defining a second inner volume extending therebetween, the tubular holder disposed between the first filter element and the second filter element;

a first flavor releasing mechanism located within the second inner volume.

2. The insert system of claim 1 wherein the first flavor mechanism is located entirely within the second volume.

3. The insert system of claim 1 wherein the first flavor mechanism is separated from the third open end by a first distance and from the fourth open end by a second distance.

4. The insert system of claim 1 wherein the husk material includes corn husk material.

5. An insert system for use as a mouthpiece to a smokable item and for securing at least one flavor releasing mechanism, the insert system comprising:

an elongate member with a first open end and a second open end opposite the first open end defining a first inner volume extending therebetween;

a first filter element comprising first filter material within the inner volume and directly adjacent the first open end;

a second filter element comprising second filter material within the inner volume and directly adjacent the second open end;

a tubular holder comprising rubber and having a third open end and a fourth open end opposite the third open end defining a second inner volume extending therebetween, the tubular holder disposed between the first filter element and the second filter element;

a first flavor releasing mechanism located within the second inner volume.

6. The insert system of claim 5 wherein the first flavor mechanism is located entirely within the second volume.

7. The insert system of claim 5 wherein the first flavor mechanism is separated from the third open end by a first distance and from the fourth open end by a second distance.

8. The insert system of claim 5 wherein the first filter material and/or the second filter material includes husk material.

9. The insert system of claim 8 wherein the husk material includes corn husk material.

* * * * *